United States Patent [19]

Kaminski

[11] 4,377,084

[45] Mar. 22, 1983

[54] PRESS APPARATUS HAVING RESILIENT STOP BLOCKS

[75] Inventor: Elton G. Kaminski, Sidney, Ohio

[73] Assignee: The Stolle Corporation, Sidney, Ohio

[21] Appl. No.: 220,511

[22] Filed: Dec. 29, 1980

[51] Int. Cl.[3] ..... B21D 28/10; B21D 28/18

[52] U.S. Cl. ..... 72/325; 72/455; 72/465; 413/17; 413/67; 267/130; 267/181; 83/617

[58] Field of Search ..... 72/325, 455, 456, 465, 72/462, 466; 267/181, 130; 413/17, 67; 83/617

[56] References Cited

U.S. PATENT DOCUMENTS

| | | | |
|---|---|---|---|
| 541,456 | 6/1895 | Richardson | 72/465 |
| 2,320,240 | 5/1943 | Janiszewski | 72/456 |
| 2,595,818 | 5/1952 | Smila | 267/181 |
| 3,036,337 | 5/1962 | Burnham | 100/259 |
| 3,111,053 | 11/1963 | Svensson | 72/456 |
| 3,333,447 | 8/1967 | Alspaugh | 72/465 |
| 3,426,571 | 2/1969 | Hoffman | 72/456 |
| 4,043,546 | 8/1977 | Ashfield et al. | 267/181 |
| 4,133,096 | 1/1979 | Falcioni | 72/465 |

FOREIGN PATENT DOCUMENTS

| | | | |
|---|---|---|---|
| 656378 | 9/1963 | Italy | 72/465 |
| 583860 | 12/1977 | U.S.S.R. | 72/456 |

*Primary Examiner*—Daniel C. Crane
*Attorney, Agent, or Firm*—Frost & Jacobs

[57] ABSTRACT

A resilient stop block for gradually loading the ram of a press for scoring easy open can ends to assure an accurately controlled residual and reduce press noise. The resilient stop block replaces the conventional solid stop block and comprises a metallic member having a longitudinal bore and vertically spaced overlying pairs of diametrically opposed angularly oriented segmental slots extending inwardly through the sides of the block into the bore. The resilient stop block is compressable by the overlying solid stop block as the ram approaches the press bed.

12 Claims, 7 Drawing Figures

PRESS APPARATUS HAVING RESILIENT STOP BLOCKS

SUMMARY OF THE INVENTION

The present invention is directed generally to a press having tooling for scoring metallic blanks, and more particularly to such a press having resilient stop blocks for controlling the clearances of the tooling in the closed position.

For purposes of an exemplary showing, the present invention will be described and illustrated in connection with a mechanical press having a stationary press bed including a lower tool holder mounting a scoring die, and a vertically movable press ram overlying the bed and including an upper tool holder mounting a scoring punch. This type of press finds particular utility for scoring from a sheet of metallic stock the easy open portion or end associated with a metal can.

The scoring operation which defines the removable portion of the can end establishes a metal residual or unscored metal portion having a relatively critical thickness. It has been found that excessive residual makes the easy open end difficult or impossible to open. On the other hand, too little residual metal allows the end to fail since it cannot withstand the pressure or vacuum inside the can. Such metal residual tolerances are often held to a maximum variation of 0.0005 inches.

It is well known that all mechanical presses contain clearances which allow lubricating oil to penetrate so that the working surfaces can be adequately lubricated. These clearances, which affect the true bottom dead center position of the press ram, between the crank shaft or eccentric shaft and the connecting rods, and between the end of the connecting rod and the press ram proper. Although the total clearance varies with the size of the press, it is not uncommon for presses used for easy open end production to have total clearances of 0.013 inches or more.

Traditionally, compensation for such press clearances has been provided by the use of solid cylindrical stop blocks fixedly secured in facing relationship to the ram and bed. Facing surfaces of the stop blocks are vertically adjusted to make contact as the ram descends toward the bed in order to preload the press to the degree necessary to eliminate the aforementioned clearances in order to produce the desired metal residual in the easy open end.

While such stop blocks adequately solve the clearance problem, it has been found that the instantaneous loading applied to the press when opposing stop blocks contact each other significantly increases the noise level of the press as well as wear of the moving parts. Such problems become even more undersirable as the speed of press operation is increased.

The present invention is directed to resilient stop means positioned between the ram and the bed for controlling the closed position of the die and punch. In a preferred embodiment, the resilient stop means includes a plurality of spaced cylindrical solid metallic stop blocks of conventional construction fixedly secured to and depending downwardly from the press ram. Each of the solid blocks has a substantially flat lower end face positioned in facing relationship with the bed.

The invention also includes a plurality of spaced cylindrical resilient stop blocks fixedly secured to and extending upwardly from the bed beneath a corresponding one of the solid blocks. Each of the resilient blocks comprises a metallic member having a flat upper end face configured to abut the overlying solid block face as the die and punch approach the closed position, and a longitudinal bore extending therewithin through the face of the block. The resilient block further includes vertically spaced overlying pairs of diametrically opposed segmental slots extending inwardly through the sides of the resilient block into the bore and a pair of similarly configured slots positioned between and perpendicular to the first mentioned pairs of slots.

As will be described in more detail hereinafter, the portions of the resilient block between the slots acts as simple beams permitting the resilient block to deflect along the longitudinal axis. Consequently, the resilient stop block is compressible by the solid stop block as the ram approaches the bed for gradually preloading the press to accurately control punch penetration and the thickness of the residual. It will be observed that the resilient stop block is thus contacted at an earlier point as the ram descends downwardly to impose its load to the press gradually. This gradual preloading of the press takes up the press clearances over a longer period of time reducing the shock loading on the press and minimizing noise.

While it is believed that devices having construction similar to the resilient stop block described herein have been used, they have not, to applicant's knowledge, been used in the type of press described herein. In fact, such a substitution could not be made because of the substantial adaptation necessary to make this construction applicable to the type of press described herein.

Further features of the invention will become apparent from the detailed description which follows.

DETAILED DESCRIPTION

Figure 1:
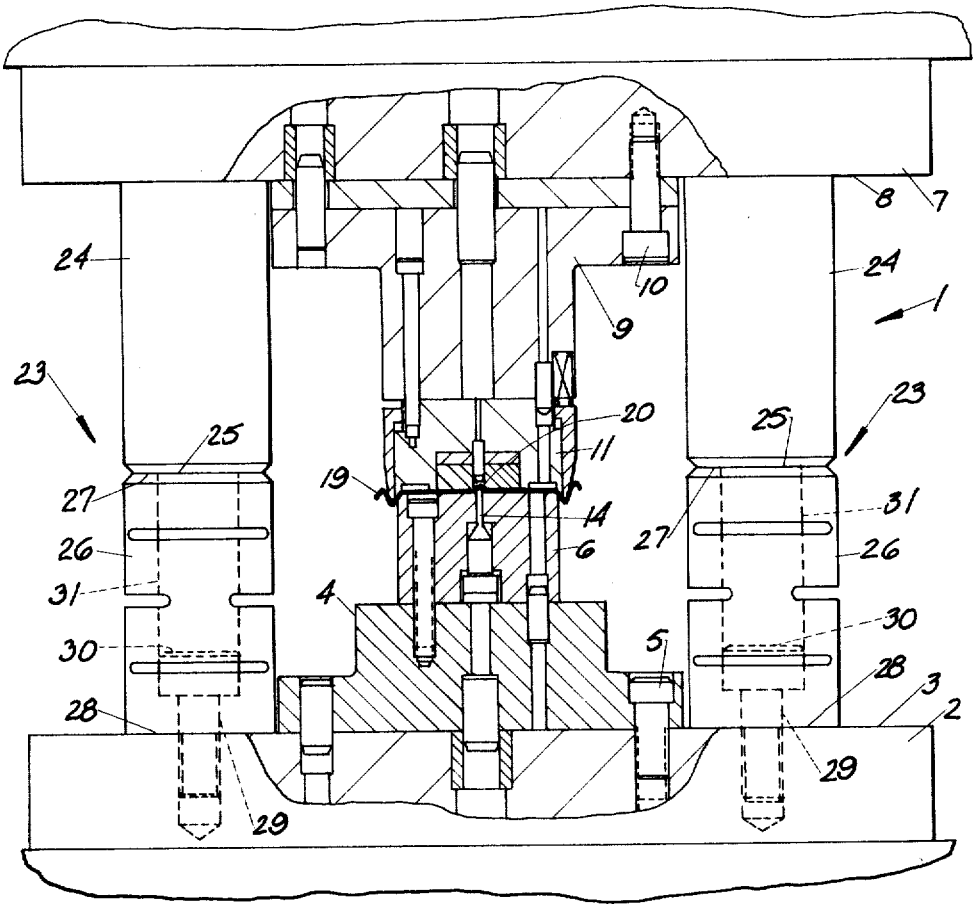
FIG. 1 is a fragmentary front partially cut-away cross sectional view of a press apparatus using the resilient stop blocks of the present invention with the tooling shown in the closed position.

FIG. 1 illustrates a conventional press, illustrated generally at 1, having a stationary press bed 2 including a generally planar horizontal upper surface 3. Surface 3 supports a conventional lower tool holder 4 which is mounted to the bed by means of fasteners 5. Lower tool holder 5 mounts a scoring die 6 configured to form an easy open end as will be described in more detail hereinafter.

A vertically displaceable press ram 7 overlies bed 2 and includes a generally planar horizontal surface 8 which mounts an upper tool holder 9 by means of fasteners 10. Upper tool holder 9 mounts a scoring punch 11 configured to cooperate with scoring die 6 to form the easy open end.

Figure 2:
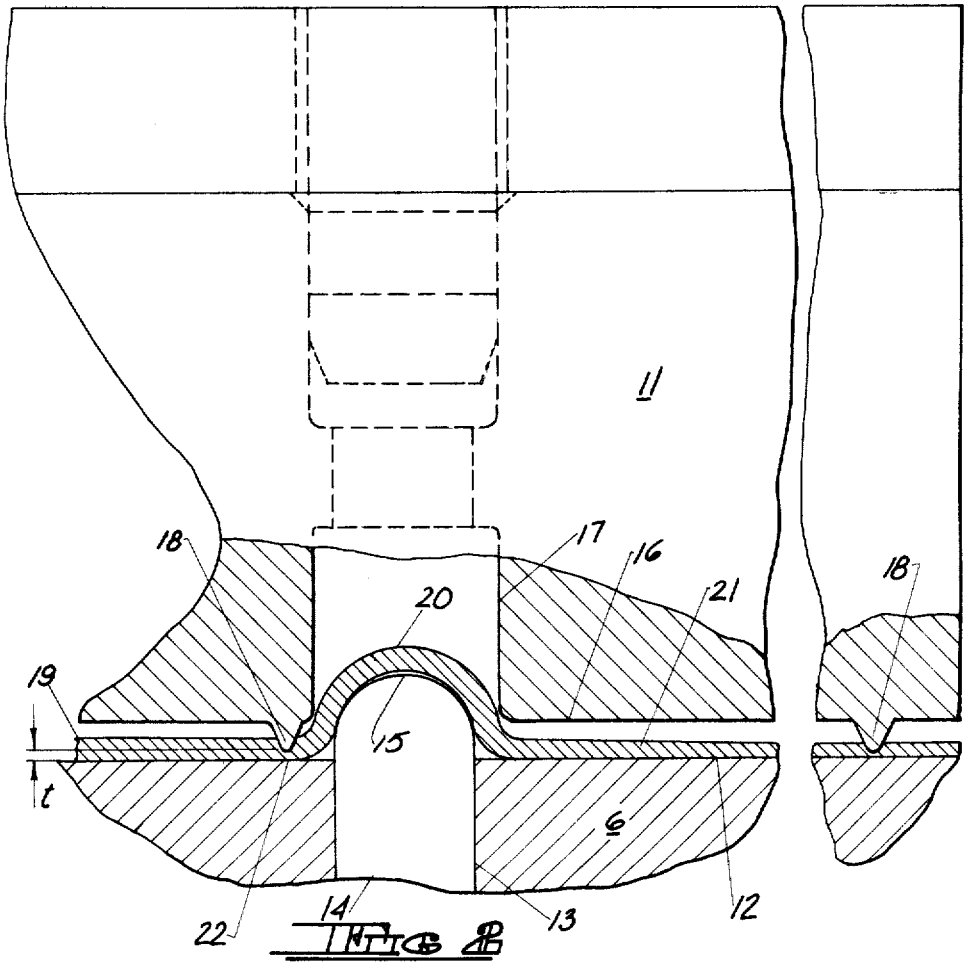
FIG. 2 is an enlarged fragmentary partially cut-away cross sectional view illustrating the scoring punch and residual detail of the press of FIG. 1.

Die 6 and punch 11 are illustrated in more detail in FIG. 2. Die 6 includes a flat upper die surface 12 and a centrally positioned cylindrical bore 13. A cylindrical punch 14 having a hemispherical upper end 15 is slidably restrained within bore 13 for vertical movement therewithin such that hemispherical end 15 may be displaced above die surface 12.

Scoring punch 11 includes a flat lower surface 16 configured to mate with die surface 12, and a centrally located bore 17 positioned immediately above punch 14. Scoring punch surface 16 includes a pair of spaced downwardly depending projections 18 for creating the score lines in the surface of the easy open end.

As illustrated in FIG. 2, the metallic sheet 19 is positioned on die surface 12, and scoring die 6 descends against sheet 19 to form the score lines by means of projections 18. At the same time, hemispherically ended punch 14 moves upwardly to create the spherical rivet portion 20 of the easy open end. It will be observed that the tab portion 21 of sheet 19 lying between the score lines remains attached to the remaining portion of the easy open end by a section of unscored metal or residual 22. As noted hereinabove, the thickness t of the residual must be accurately controlled to insure proper operation of the tab or end portion 21.

The present invention includes resilient stop means, shown generally at 23 positioned between press bed 2 and press ram 7 for controlling the closed position of the tooling consisting of scoring die 6 and scoring punch 11 in order to accurately determine the thickness of residual 22 securing the scored end to the sheet.

In a preferred embodiment, resilient stop means 23 comprises a plurality of spaced cylindrical solid metallic stop blocks 24 fixedly secured to and depending downwardly from ram mounting surface 8. Each of the solid stop blocks 24 bears a substantially flat lower end face 25 positioned in facing relationship with press bed 2.

A plurality of spaced cylindrical resilient stop blocks 26 are fixedly secured to and extend upwardly from bed surface 3 on either side of lower tool holder 4 beneath a corresponding one of solid blocks 24. Each resilient stop block 26 comprises a metallic member which may be fabricated from a prehardened steel bar having a flat upper end face 27 configured to abut the overlying solid stop block end face 25 as the die and punch approach the closed position. The opposite end of resilient stop block 26 is provided with a smoothly finished surface 28 and a bore 29 for fixedly securing the resilient stop block to press bed 2 by means of threaded fastener 30.

Figure 5:
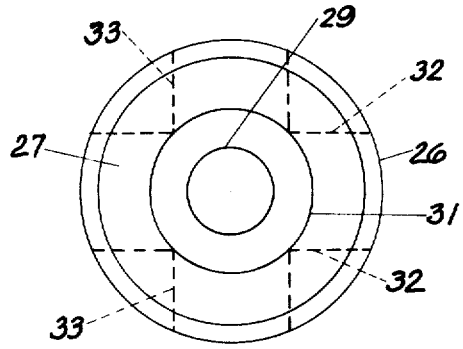
FIG. 5 is a top plan view of the resilient stop block of the present invention.
Figure 3:
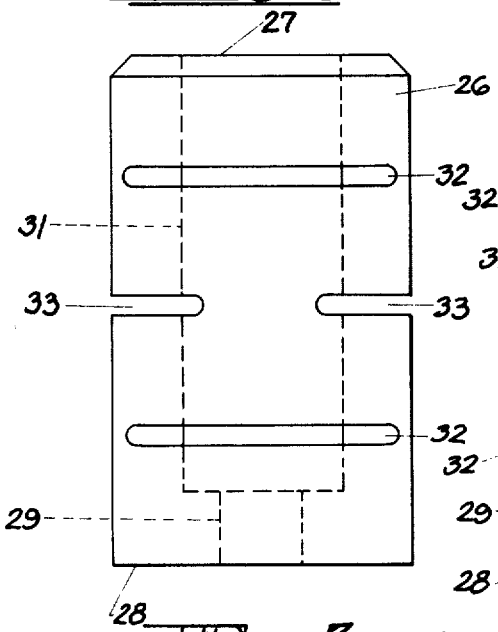
FIG. 3 is a front elevation view of the resilient stop block of the present invention.
Figure 4:
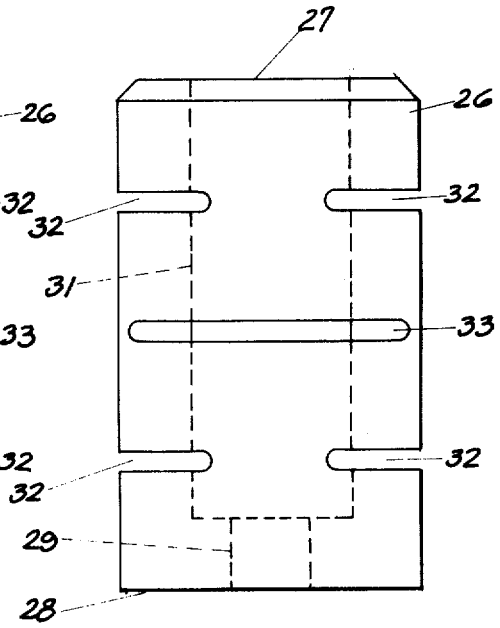
FIG. 4 is a side elevation view of the resilient stop block of the present invention.

The interior of resilient stop block 26 is provided with a longitudinal bore 31 extending through upper end face 27 to a depth spaced from lower end 28. As best shown in FIG. 3–FIG. 5, resilient stop block 26 is provided with vertically spaced overlying pairs of diametrically opposed segmental slots 32 extending inwardly through the sides of block 26 into bore 31. A pair of similarly configured diametrically opposed slots 33 is positioned between and aligned perpendicular to slots 32.

It will be observed that each resilient stop block 26 forms a stacked series of simple beams. It will also be observed that although for purposes of an exemplary showing the resilient stop block has been described and illustrated as having a circular cross sectional configuration, it could also be fabricated in a square or rectangular shape. In the design illustrated, where the block has a total of eight simple beams, each beam absorbs ⅛ of the total stop block deflection. The block is so designed that this deflection does not exceed the yield strength of the material, allowing each beam to fully recover and the entire stop block to return to its normally relaxed position.

Figure 6:
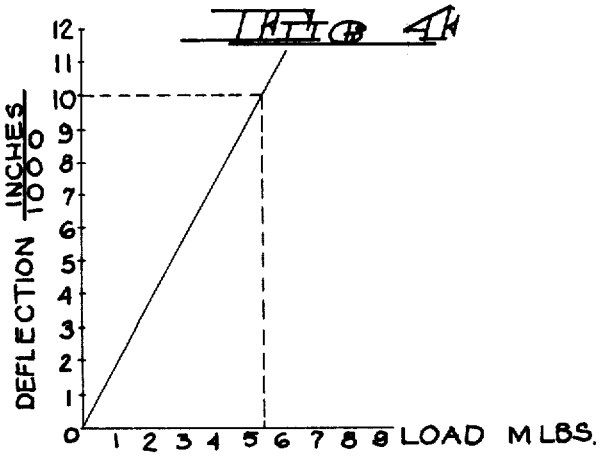
FIG. 6 is a graphical representation of the deflection under load of the resilient stop block of the present invention.

As can be seen from the graphical representation of FIG. 6, the deflection of the resilient stop block is linear with the applied load. For example, if the stop blocks are installed so that the resilient stop block 26 is contacted by the solid stop block 0.010 inches before the score residual 22 is established, each resilient stop block 26 exerts 5,550 pounds of force to compress 0.010 inches. Consequently, four resilient stop blocks used as described hereinabove would exert a total force against press ram 7 of eleven tons. In other words, resilient stop blocks 26 are compressed by the solid stop blocks as ram 7 approaches bed 2 for gradually preloading the press to accurately control the penetration of the punches or projections 18 and consequently the thickness of residual 22. As the tools approach the closed position, the resilient stop blocks progressively reduce the press clearances.

It will be observed that the configuration of the resilient stop block 26 may be changed to achieve different spring constants. For example, additional slots would decrease the spring constant, while a larger outside diameter with the same inside diameter and slot spacing would increase the spring constant. The configuration of the resilient stop block can be changed to suit a given application and press clearance characteristics.

Figure 7:
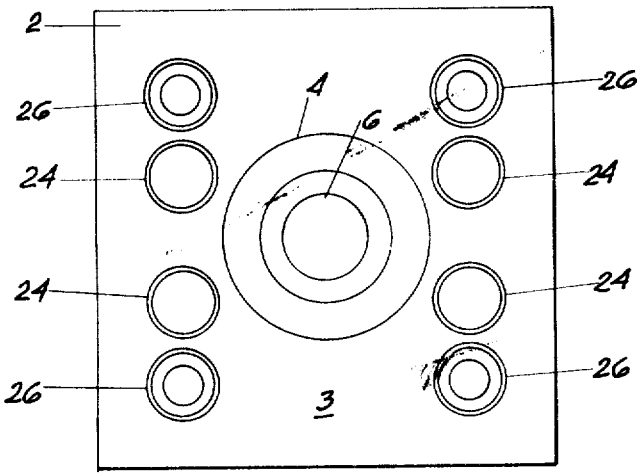
FIG. 7 is a diagrammatic top plan view of the press bed illustrating an alternate stop block arrangement.

FIG. 7 illustrates somewhat diagrammatically an alternative arrangement using a combination of resilient stop blocks 26 and solid stop blocks 24 positioned on the upper bed surface 3 to control the press clearances. In this arrangement, resilient stop blocks 26 operate in connection with an overlying solid stop block 24 (not shown) in the manner described hereinabove. In addition, the solid stop blocks 24 positioned laterally adjacent resilient stop blocks 26 would be adjusted so that when the solid stop blocks overlying them are finally contacted, the precise closed position of the tool is established.

It will be understood that various details, materials, steps and arrangements of parts, which have been herein described and illustrated in order to explain the nature of the invention, may be made by those skilled in the art within the principle and scope of the invention as expressed in the appended claims. For example, while for purposes of an exemplary showing, solid stop blocks 24 have been described as associated with press ram 7, while resilient stop blocks 26 have been described as associated with press bed 2, it will be understood that the relative positions of these members may be reversed, or intermixed. Likewise, the solid stop blocks may be replaced by resilient stop blocks, or the solid stop blocks may be eliminated altogether such that the upper end faces 27 of the resilient stop blocks bear directly against ram mounting surface 8. Likewise, the resilient stop blocks alone may be directly connected to press ram 7 so that the flat face 27 bears directly against bed surface 3 when the tooling is in the closed position.

In addition, as used herein, the term "segmental" used in connection with the slots means that the slots are provided through the surface of the resilient stop block body transversely to the longitudinal axis of the resilient stop block and to less than ½ of the depth of the block.

The embodiments of the invention in which an exclusive property or privilege is claimed are as follows:

1. In a press of the type having a stationary press bed including a lower tool holder mounting a scoring die and a vertically movable press ram overlying said bed including an upper tool holder mounting a scoring punch for scoring a sheet of stock material to form an easy open can end having a residual, the improvement in combination therewith comprising resilient stop means fixedly secured to said press bed and extending toward said ram for controlling the closed position of the tooling including at least one resilient stop block formed by a block-like member having a longitudinal axis extending substantially perpendicular to said bed and ram and a plurality of longitudinally spaced angularly aligned slots extending inwardly through the sides of said block and oriented transversely to the longitudinal axis of said block, and at least one solid metallic stop block fixedly secured to said press ram and extending toward said bed in axial alignment with said resilient stop block, each of said blocks having substantially flat faces formed on their outer ends, said blocks being positioned such that said faces make contact as said tooling approaches the closed position, said resilient and solid stop blocks forming a resilient-solid block pair, said resilient stop block being compressable as said bed and ram aproach each other to gradually preload the press and being positioned and configured to accurately control the thickness of the residual.

2. The press according to claim 1 wherein said resilient stop block is formed from a metallic material.

3. The press according to claim 2 wherein said metallic material comprises hardened steel.

4. The press according to claim 1 wherein said plurality of slots comprises a first pair of diametrically opposed segmental slots and a second pair of diametrically opposed segmental slots longitudinally spaced from and aligned perpendicular to said first pair of slots.

5. The press according to claim 4 wherein said plurality of slots further includes a third pair of diametrically opposed segmental slots spaced from and aligned substantially parallel with said first pair of slots, said second pair being positioned between said first and third pairs.

6. The press according to claim 1 including a central bore extending longitudinally within said block resilient stop, said slots extending into said bore.

7. The press according to claim 1 including a solid stop block pair fixedly secured to said bed and ram adjacent said resilient-solid block pair and positioned to make contact after contact has been made between the resilient-solid block pair.

8. The press according to claim 1 including a plurality of said resilient stop blocks positioned in spaced relationship.

9. The press according to claim 1 wherein said resilient stop block member is of substantially cylindrical cross section.

10. In a press of the type having a stationary press bed and a vertically movable press ram overlying said bed, said bed and ram mounting a scoring die and punch for scoring from a sheet of stock material an easy-open can end having a residual securing the scored end to the sheet, the improvement in combination therewith including resilient stop means positioned between said ram and said bed for controlling the closed position of said die and punch comprising a plurality of spaced solid metallic stop blocks fixedly secured to and depending downwardly from said press ram, each of said solid blocks having a substantially flat lower end face positioned in facing relationship with the bed, and a plurality of spaced resilient stop blocks fixedly secured to and extending upwardly from said bed beneath a corresponding one of said solid stop blocks, each of said resilient blocks comprising a metallic member having a flat upper end face configured to abut the overlying solid block face as the die and punch approach the closed position and a longitudinal bore extending therewithin through said face, said resilient block further including vertically spaced overlying pairs of diametrically opposed segmental slots extending inwardly through the sides of said block into said bore and a pair of similarly configured diametrically opposed slots positioned between and perpendicular to said first mentioned pairs of slots, said resilient stop block being compressable by said solid stop block as the ram approaches the bed for gradually preloading the press to accurately control punch penetration and the thickness of the residual.

11. The press according to claim 10 wherein said resilient stop block metallic member is of substantially cylindrical cross section.

12. The press according to claim 10 including an upper solid metallic stop block fixedly secured to and depending downwardly from said press ram adjacent each of said first mentioned solid stop blocks, each of said upper solid stop blocks having a substantially flat lower end face positioned in facing relationship with the bed, and a lower solid metallic stop block fixedly secured to and extending upwardly from said bed in underlying axial alignment with the corresponding one of said upper solid stop blocks, each of said lower solid stop blocks having a flat upper end face configured to abut the overlying solid stop block face as the die and punch approach the closed position, said solid stop blocks being positioned to make contact with each other at a ram position after contact is made between a corresponding resilient stop block and solid stop block as the ram descends toward the bed.

* * * * *